United States Patent [19]

Yamada et al.

[11] Patent Number: 4,802,356

[45] Date of Patent: Feb. 7, 1989

[54] APPARATUS OF PROCESSING CONTINUOUSLY CAST SLABS

[75] Inventors: Tsuneo Yamada, Nishinomiya; Tsutomu Sakashita, Ibaraki; Hiroshi Tomono; Takashi Kimura, both of Osaka; Yasuhiro Maehara; Kunio Yasumoto, both of Kobe, all of Japan

[73] Assignee: Sumitomo Metal Industries, Ltd., Osaka, Japan

[21] Appl. No.: 82,360

[22] Filed: Aug. 6, 1987

Related U.S. Application Data

[62] Division of Ser. No. 760,453, Jul. 30, 1985, Pat. No. 4,709,572.

[30] Foreign Application Priority Data

| | | | |
|---|---|---|---|
| Jul. 31, 1984 | [JP] | Japan | 59-161183 |
| Aug. 20, 1984 | [JP] | Japan | 59-171439 |
| Aug. 20, 1984 | [JP] | Japan | 59-171440 |

[51] Int. Cl.[4] ..... B21B 1/46; B21B 11/00; C21D 8/00

[52] U.S. Cl. ..... 72/184; 72/190; 72/206; 164/263; 164/417

[58] Field of Search ..... 72/206, 184, 190;

[56] References Cited

U.S. PATENT DOCUMENTS

| | | | |
|---|---|---|---|
| 2,228,257 | 1/1941 | Collins | 29/527.7 |
| 2,310,703 | 2/1943 | McGlincy | 148/2 |
| 3,333,452 | 8/1967 | Sendzimir | 72/184 |
| 3,630,269 | 12/1971 | Bieri | 164/263 |
| 3,780,552 | 12/1973 | Staskiewicz et al. | 164/263 X |
| 4,057,989 | 11/1977 | Takechi et al. | 72/160 |
| 4,106,318 | 8/1978 | Yanagimoto et al. | 72/205 |
| 4,134,440 | 1/1979 | Kawawa et al. | 164/414 |

FOREIGN PATENT DOCUMENTS

| | | | |
|---|---|---|---|
| 0007497 | 4/1979 | Japan | 164/476 |
| 0059519 | 5/1981 | Japan | 164/417 |
| 967712 | 8/1964 | United Kingdom | 164/417 |
| 84/00916 | 3/1984 | World Int. Prop. O. | 164/417 |

*Primary Examiner*—Robert L. Spruill
*Assistant Examiner*—Steven B. Katz
*Attorney, Agent, or Firm*—Burns, Doane, Swecker & Mathis

[57] ABSTRACT

A method and apparatus of processing a continuously cast slab to prevent the formation of surface cracks by applying plastic strains to the surface layer of the slab in which a process of solidification is taking place. The method comprises pressing a projection against the slab surface under specified conditions prior to introducing the slab to a leveling stage.

7 Claims, 10 Drawing Sheets

APPARATUS OF PROCESSING CONTINUOUSLY CAST SLABS

This application is a divisional of application Ser. No. 760,453, filed July 30, 1985 now U.S. Pat. No. 4,709,572.

BACKGROUND OF THE INVENTION

This invention relates to a method and apparatus for processing slabs which have been manufactured by continuous casting (hereunder referred to merely as "continuously cast slab)".

In particular, this invention relates to a method and apparatus of preventing the formation for cracks during hot working in the manufacture of a slab by a continuous casting process and to a method and apparatus for preventing the formation of cracks during so-called "direct rolling" or "hot charge rolling".

Steels to which this invention can be successfully applied are medium or low carbon steels containing either Si or Mn, and low alloy steels which contain at least one alloying element, such as Al, Nb, Ti, Ta, V, and B, each in an amount of less than 1%.

"Direct rolling" means a rolling process in which hot slabs manufactured through continuous casting are subjected to hot rolling immediately after continuous casting without preheating. "Hot charge rolling" means a rolling process in which hot slabs manufactured through continuous casting are rolled immediately after reheatign them slightly without cooling to room temperature.

In the manufacture of these medium or low-carbon steels and low-alloy steels using a bending-type continuous casting machine, surface cracks are frequently formed on cast slabs due to thermal stresses and bending stresses which are caused by cooling and straightening. The incidence of such cracks is especially sever with Nb-containing steels.

It is necessary to remove these cracks before proceeding to the next stage of manufacture. Usually, this requires cooling to room temperature.

Direct rolling and hot charge rolling are advantageous because they do not require cooling to room temperature nor heating to a rolling temperature from room temperature. Therefore, the formation of such cracks makes these processes impossible.

Even if cracks are not formed during casting, they are sometimes formed during rolling, i.e, direct rolling, hot charge rolling, etc. In this case, too, the formation of these cracks makes these processes impossible.

It is said that a high sulfur steel inevitably suffers from cracking during hot rolling.

Therefore, in order to carry out hot working in a continuous and inexpensive manner through direct rolling or hot charge rolling, it is desirable that the formation of cracks on cast slabs during continuous casting or during direct rolling or hot charge rolling be completely prevented. In addition, even when a continuously cast slab is cooled to room temperature and then is reheated to a hot rolling temperature, cast slabs which are free from surface cracks are advantageous since conditioning by scarfing is not necessary. Thus, in this case, too, it is desirable to completely prevent the formation of cracks in a continuous casting process.

Japanese Patent Application Laid-Open Specification No. 128255/1983 discloses a method of blowing metal shot onto a slab surface to prevent the formation of surface cracks of a continuously cast slab. However, the purposes of this method are to pressure weld the cracks, to remove extraneous matter from the surface ofa slab, and to suppress oxidation of the slab surface. Such treatment is carried out just when the slab leaves a mold and before going into guid rollers. Cracks frequently develop in the steps following the casting, e.g., during rolling. Thus, this method is not a complete solution of the problem.

Japanese Patent Application Laid-Open Specification No. 155123/1979 discloses a method of applying plastic strain to a cast slab while controlling the amount of plastic strain, the cast slab temperature, and the austenitic particle size. However, according to the experience of the inventors of this invention, it is impossible to completely prevent the formation of cracks by regulating only these factors.

Furthermore, means for imparting plastic strain, which are suggested therein, are rolling, shot-blasting, laser pulse application, and the like. These means are not sufficient to impart a satisfactory plastic strain. Namely, when rolling is applied with usual rolls to a portion of a slab which is only partially solidified, the shell of the solidified metal only becomes concave without the desired strains being formed in the skin surface of a cast slab. On the other hand, shot-blasting produces plastic strains only to a shallow depth, resulting in no remarkable effects.

Furthermore, with shot-blasting, it is troublesome to collect the shot after blasting, and therefore this process is not considered practical.

A method utilizing a laser pulse applies heat to a depth of a few dozen μm so as to produce strain due to thermal differences between the surface of slab and the inner portion thereof. This method, however, is not effective with hot slabs, since it is not possible to achieve any significant thermal differences when a laser pulse is applied to a hot cast slab. The presence of coolant water on the surface of a slab also makes this process impractical.

Japanese Patent Application Laid-Open Specification No. 52442/1983 proposes a method of controlling the cooling rate in a continuous casting process so as to prevent the formation of cracks. However, according to the method disclosed therein, the cooling rate is controlled so as to be small, and it takes an extremely long time before the cooling is completed. Therefore, this method, too, is impractical.

OBJECTS OF THE INVENTION

An object of this invention is to prevent the formation of cracks such as surface cracks in cast slabs during continuous casting and during direct rolling as well as hot charge rolling.

Another object of this invention is to make the direct rolling as well as hot charge rolling feasible with a remarkable reduction in manufacturing costs.

As a result of investigations by the present inventors concerning surface flaws such as surface cracks in continuously cast slabs, it was found that these cracks are caused by deformation carried out at a low strain rate, which is achieved by thermal stresses rendered when a slab is cooled through a low austenite (gamma) range and sometimes a co-existing range of austenite and ferrite (alpha), and by external stresses applied to slabs during leveling after solidification. (See Mat. Sci. Eng., 62 (1984) pp. 109–119 and Trans. JIM, 25 (1984) pp. 160–167). In addition, cracks during hot rolling are formed at a high strain rate at relatively low gamma range temperatures and are caused by the fracture of gamma grains.

Embrittlement brought about during deformation at a low strain rate is caused not only by a continuous precipitation of carbides, nitrides, and carbo-nitrides such as AlN, NbC, TaC, TiC, and VN along the boundaries of gamma grains but also by a fine precipitation occurring within the grain. The embrittlement is also accelerated by the fact that a soft film-like ferrite phase (alpha) is precipitated along grain boundaries, and the area within the grain is strengthened relative to the grain boundary area, resulting in a concentration of strain in a precipitation-free zone along the gamma grain boundaries and in a film-like ferrite phase precipitate. Thus, due to such a stress concentration, cleavage fracture takes plae between the matrix phase and the grain-boundary precipitate. [ibid.]

Embrittlement brought about by deformation at a high strain rate during hot rolling is caused by a continuous precipitation of (Fe, Mn)S taking place along gamma-grain boundaries during deformation and by a fine precipitation occurring throughout the grain. When the carbo-nitrides are continuously precipitated along the gamma grain boundaries as well as in the grain before deformation at a high strain rate, the embrittlement due to the precipitation of the (Fe, Mn)S is accelerated markedly.

Therefore, it has been noted from the above that in order to prevent embrittlement due to gamma grain boundary fracture (intergranular fracture) it is advisable to refine gamma grains so as to render the grains insensitive to embrittlement. Alternatively, it is advisable, prior to deformation, i.e., prior to leveling or hot rolling of cast slabs, for example, to cause the precipitate to grow coarse so as to prevent precipitation along a gamma grain boundary and fine precipitation within the grain. However, satisfactory measure have not yet been worked out because of restrictions regarding fixtures, operating conditions and the like. Coagulation of precipitates can be achieved successfully by reducing the cooling rate or by maintaining slabs at a constant temperature during cooling. In respect to carbo-nitrides, see Mat. Sci., 62 (1984) pp. 109–119, and regarding sulfides, see Japanese Patent Application Laid-Open Specification No. 52442/1983. However, according to the process disclosed therein, it takes an extremely long time to achieve the desired cooling, rendering this process impractical.

It has also been proposed to achieve refinement by utilizing recrystallization of gamma grains (see Japanese Patent Application Laid-Open Specification No. 155123/1979). However, since the starting gamma grains are extremely coarse and have a small area of recrystallized grain boundaries, it is necessary to apply high strain. It is also stated therein that it is necessary to provide fine crystal grains having a particle size of 0.1 mm or smaller.

In order to provide such fine crystal grains it is necessary to apply a plastic strain of 40% or more. However, it is impossible to perform such a high degree of working on a cast slab which partly contains a melt, i.e. an unsolidified portion.

In light of the above-mentioned mechanism by which embrittlement takes place, it is also conceivable to suitably adjust a steel composition so as to prevent the formation of surface cracks. However, steel composition is restricted to some extent in view of its nature and the requisite properties. Since there are many restrictions to satisfy, adjusting the steel composition is not a complete solution of the problem. For example, in order to prevent the precipitation of AlN, it is helpful to reduce the content of Al and N or to fix nitrogen as TiN by adding Ti, resulting in an improvement in ductility. However, this measure adds to manufacturing costs, and the addition of Ti impairs the toughness of welded portions. The addition of Nb is sometimes essential to attain the desired properties of the final products. There is no alternative way to attain the same properties.

Furthermore, it is also effective to reduce the sulfur content. However, this requires additional manufacturing steps which increase costs, and a decrease in the total manufacturing cost cannot be expected.

SUMMARY OF THE INVENTION

The inventors of this invention found that the formation of surface cracks in a continuously cast slab during leveling and the succeeding hot working can be prevented by producing deformation under specified conditions before the leveling.

Thus, this invention is a method of processing a continuously cast slab to prevent the formation of surface cracks by applying plastic strain to the surface layer of the slab in which solidifications is taking place, comprising pressing a projection against the slab surface to a depth of 1–5 mm at a frequency of at least 50 times per minute prior to introducing the slab to a leveling stage.

In one aspect, this invention resides in a method of processing a continuously cast slab, characterized by applying plastic strains to a depth of 2 mm or more from the surface in an amount of 5% or more at a strain rate of $1\times10^{-2}S^{-1}$ or more at a surface temperature of 900°–500° C., and during the deformation or after the deformation, at least one time applying heat treatment including cooling the surface temperature of the cast slab to a temperature lower than $Ar_3$ and then heating to a temperature higher than $Ac_3$, and passing the resulting slab through a series of withdrawal rollers. The term $Ar_3$ refers to the temperature at which austenite begins to transform to ferrite during cooling, and the term $Ac_3$ refers to the temperature at which transformation of ferrite to austenite is completed during heating.

In another aspect, the present invention resides in a method of processing a continuously cast slab, characterized by imparting plastic strains to a depth of 2 mm or more from the surface in an amount of 5% or more at a strain rate ($\epsilon$) given by the following expression:

$$\dot{\epsilon} \geqq a\times\exp(bT)$$

wherein, $a=4\times10^{-5}$, $b=4.6\times10^{-3}$, T is a cast slab surface temperature, and 700° C.$\leqq T \leqq$1200° C., and then passing the resulting slab through a series of withdrawal rollers.

Preferably, the strain rate is not higher than 0.3 $S^{-1}$.

In a preferred embodiment of this invention, the deformation mentioned above may advantageously be applied with an apparatus comprising a working tool to form a dent in the slab surface, a first drive means to move the working tool back and forth towards and away from the slab surface, a second drive means to move the working tool back and forth in the direction of withdrawal of the cast slab, and a control unit connected to the first and second drive means for adjusting the movement of the working tool in the two directions.

Thus, according to this invention plastic strains of 5% or more are successfully introduced to a depth of 2 mm or more from the slab surface at the strain rate specified above.

The cast slab obtained according to the process mentioned above is free from cracking during levelling or hot working, and the slab may directly be subjected to usual hot working without reheating, or the slab may be subjected to usual hot working after reheating but without being cooled to room temperature.

"Hot working" herein means not only usual rolling, but also forging and the like which are carried out under hot conditions.

DETAILED DESCRIPTION OF THE PREFERRED EMBODIMENTS

Experimental results on the basis of which this invention has been achieved will now be explained.

A series of experiments using the following Steel A and Steel B were carried out in accordance with the processes shown below and referred to as Case 1 through Case 3.

TABLE 1

| Steel | C | Si | Mn | P | S | Al | N | Nb | $Ar_3$ Point |
|---|---|---|---|---|---|---|---|---|---|
| A | 0.12 | 0.3 | 0.9 | 0.015 | 0.005 | 0.040 | 0.0055 | 0.05 | 780° C. |
| B | 0.08 | 0.01 | 0.2 | 0.010 | 0.0015 | 0.042 | 0.0045 | — | 850° C. |

Case 1: Heating at 1350° C. → Cooling to 800° C. → Plastic Deformation at 800° C.
Case 2: Heating at 1350° C. → Cooling to 600° C. → Heating to 800° C. → Cooling to 600° C. → Plastic Deformation at 800° C.
Case 3: Heating at 1350° C. → Plastic Deformation at 700° C. at a strain rate of $1 \times 10^{-1} S^{-1}$ → Heating to 800° C. → Cooling to 600° C. → Plastic Deformation at 800° C.

Since Steel A is sensitive to surface cracking during levelling, it was deformed at 800° C. at a strain rate of $1 \times 10^{-3} S^{-1}$. In addition, since Steel B is sensitive to surface cracking during direct rolling, it was plastically deformed at 800° C. at a strain rate of $1 \times 10^{0} S^{-1}$.

The cooling to 600° C. and the heating to 800° C. were carried out to effect gamma ⇄ alpha transformation. In Case 3, prior to carrying out the transformation, a tensile strain of 20% was introduced at a rate of $1 \times 10^{-1} S^{-1}$. In each of Cases 2 and 3, the holding time at 600° C. and 800° C. was 3 minutes.

Figure 1:
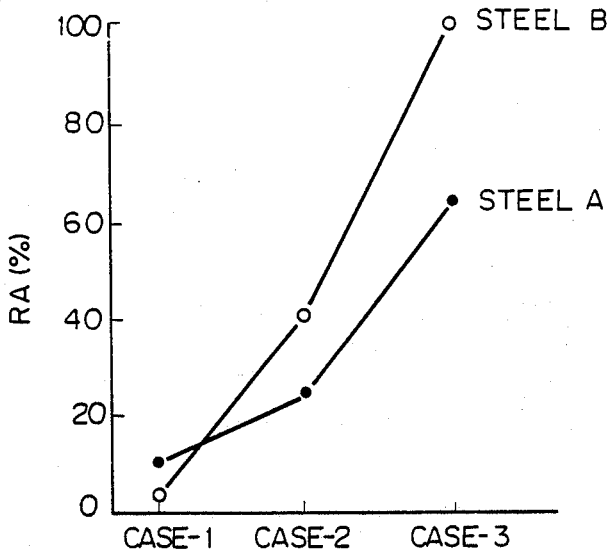
FIGS. 1 through 8 are graphs showing test results of this invention.
Figure 2:
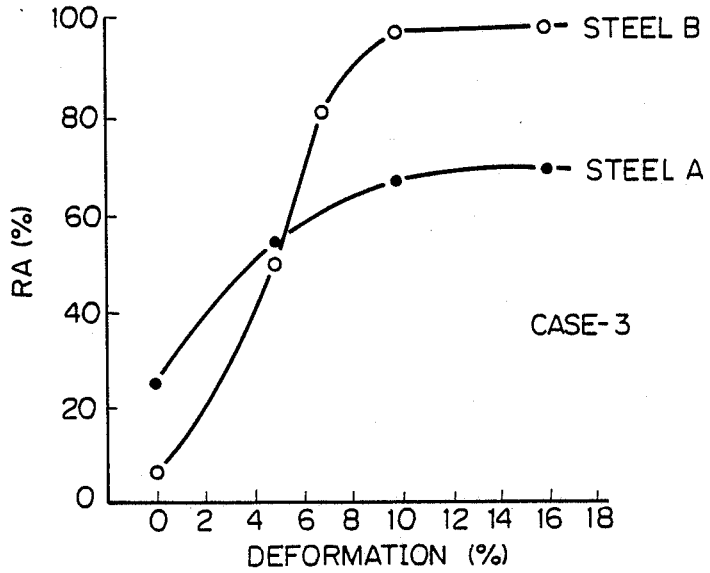
Figure 3:
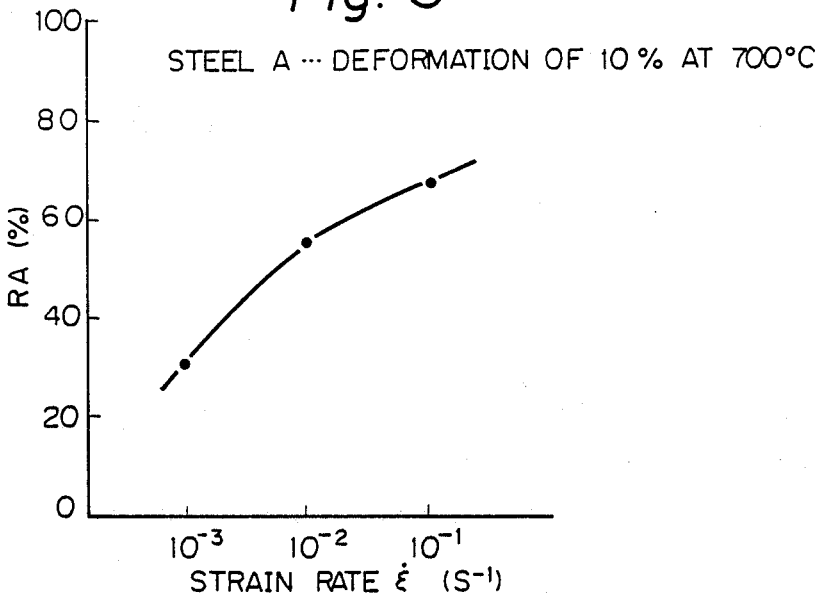

FIGS. 1–3 summarize the test results, from which it is noted that the gamma ⇄ alpha transformation after a slight deformation is very effective for improving ductility (FIG. 1) and that in order to obtain a value of RA higher than 50%, the amount of strain is preferably 5% or more and the strain rate is preferably $1 \times 10^{-1} S^{-1}$ or higher (FIGS. 2–3).

Another series of experiments was carried out using the following Steels C, D, and E according to the following processes.

TABLE 2

| Steel | C | Si | Mn | P | S | Al | N | Nb |
|---|---|---|---|---|---|---|---|---|
| C | 0.11 | 0.25 | 1.1 | 0.014 | 0.012 | 0.045 | 0.0040 | 0.05 |
| D | 0.10 | 0.30 | 1.0 | 0.015 | 0.010 | 0.040 | 0.0050 | — |
| E | 0.08 | 0.01 | 0.2 | 0.010 | 0.014 | 0.050 | 0.0045 | — |

Case 4: Heating at 1350° C. → Plastic Deformation at 850° C. at a strain rate of $1 \times 10^{-3} S^{-1}$
Case 5: Heating at 1350° C. → Cooling to 1100° C. and maintaining thereat → Plastic Deformation at 850° C. at a strain rate of $1 \times 10^{-3} S^{-1}$.
Case 6: Heating at 1350° C. → Cooling to 1100° C. → Introducing 10% strains at a rate of $1 \times 10^{-1} S^{-1}$ and maintaining at 1100° C. → Plastic Deformation at a strain rate of $1 \times 10^{-3} S^{-1}$.
Case 7: Heating at 1350° C. → Introducing 10% strains after cooling to 900° C. → Heating to 1100° C. and maintaining thereat → Plastic Deformation at a rate of $1 \times 10^{-3} S^{-1}$.
Case 8: Heating at 1350° C. → Cooling to 950° C. and introducing 3% strains at a strain rate of $1 \times 10^{-3} S^{-1}$ and then at a strain rate of $1 \times 10^{0} S^{-1}$.
Case 9: Heating at 1350° C. → Cooling to 1100° C. and maintaining thereat → Introducing at 950° C. 3% strains at a strain rate of $1 \times 10^{-3} S^{-1}$ and then at a strain rate of $1 \times 10^{0} S^{-1}$.
Case 10: Heating at 1350° C. → Cooling to 1100° C. and introducing 10% strains at a strain rate of $1 \times 10^{-1} S^{-1}$, and maintaining at 1100° C. → Plastic Deformation at 950° C. at a strain rate of $1 \times 10^{-3} S^{-1}$ and then $1 \times 10^{0} S^{-1}$.

The test results are summarized in FIGS. 4 through 8.

Figure 4:
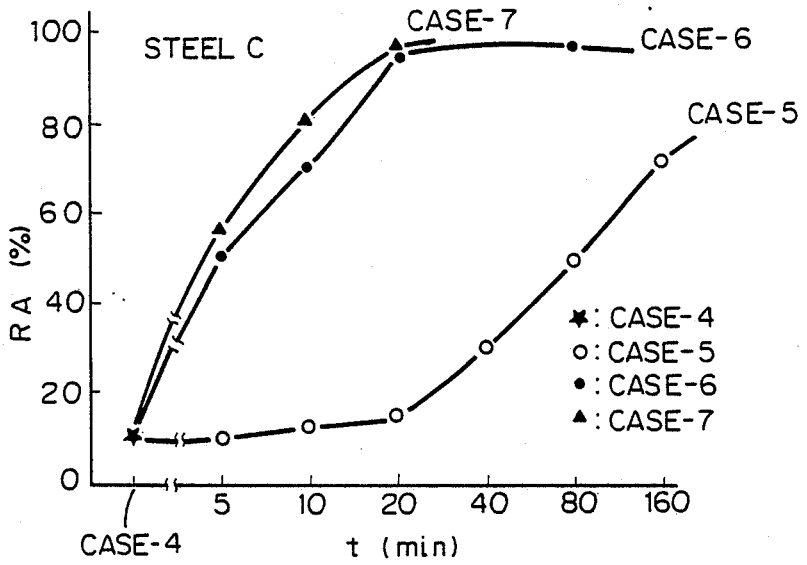

As is apparent from FIG. 4, RA was extremely small in Case 4 which was conventional. Case 5 shows that it is necessary to maintain at 1100° C. for a long period of time to increase ductility. However, when a strain of 10% is introduced at a rate of $10^{-1} S^{-1}$ prior to heating at 1100° C., ductility is markedly improved by maintaining at 1100° C. for a shorter period of time. See Cases 6 and 7. In addition, as shown by Case 7, it is preferable to utilize self-reheating (thermal recovery from the inside) of the slab by slowing down the cooling when the plastic deformation is carried out at a relatively low temperature.

Figure 5:
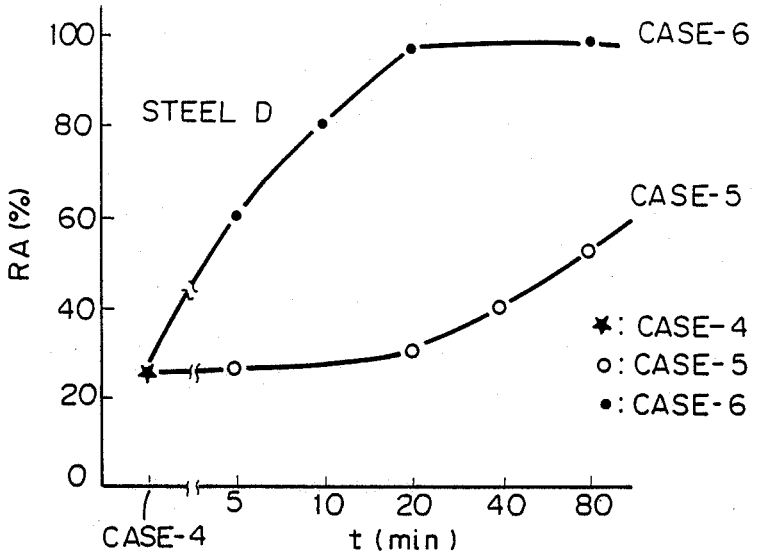

A similar graph for Steel D is shown in FIG. 5. In Case 6, a pre-deformation of 10% was applied.

It is herein to be noted that the application of plastic deformation to the surface layer of a slab is effective to prevent the formation of cracks.

Figure 6:
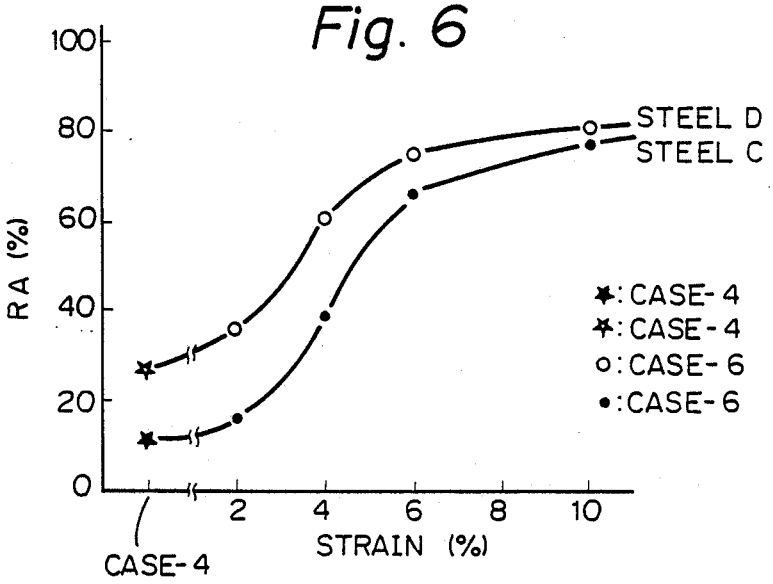

The interrelation between the amount of strain ($\epsilon$) and the value of RA for Steels C and D is shown in FIG. 6. As is apparent therefrom, a value of RA more than 50% can be attained and the slab is free from cracking when pre-deformation in an amount of 5% or more is applied. The same tendency was found for Steels C and D.

Figure 7:
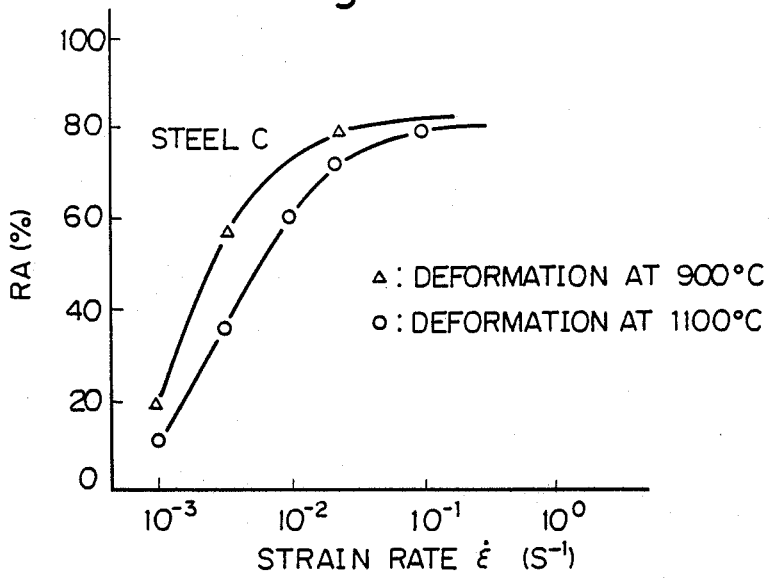

The relationship between the RA value and the strain rate is shown in FIG. 7 for Steel C in Cases 6 and 7. In Case 6 the steel was pre-deformed at 1100° C. by 10%. In Case 7 the steel was predeformed at 900° C. by 10%. The steels were maintained at 1100° C. for 10 minutes after deformation.

FIG. 7 shows that a larger strain rate is more advantageous and that the strain ($\dot{\epsilon}$) should be $\dot{\epsilon} \geqq 1 \times 10^{-2} S^{-1}$ at a pre-deforming temperature of 1100° C. and $\dot{\epsilon} \geqq 3 \times 10^{-3} S^{-1}$ at a pre-deforming tempertaure of 900° C.

Figure 8:
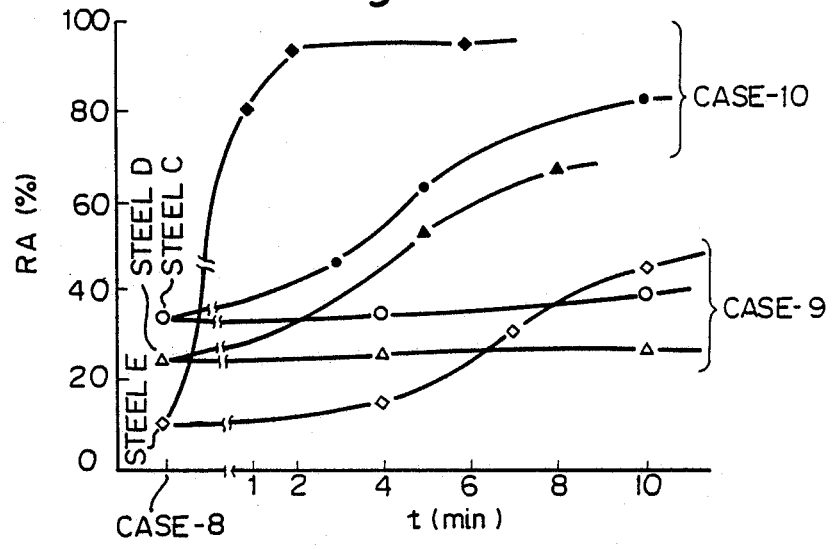

The relationship between the RA value and the maintaining period is shown in FIG. 8. In Case 8 which is conventional, RA values for Steels C, D, and E were small ones. However, when the maintaining is carried out prior to deformation, no significant results are obtained as shown in Case 9. On the other hand, as shown by Case 10, when a pre-deformation of 10% is carried out, a value of RA of larger than 50% is easily obtained by maintaining the temperature after deformation only for 4 minutes.

According to this invention, the depth to which plastic deformation is applied is restricted to at least 1–5 mm, and preferably 2 mm or more from the slab surfaces. This is based on the finding that cracks which form in a depth within 1 mm, usually within 2 mm in depth remain, resulting in crackig defects and streaking defects in the following manufacturing stages. In other words, in a preferred embodiment a given deformation should be applied to a depth at least 2 mm from the surface.

The amount of deformation is limited to not smaller than 5%, because it is difficult to effect nucleation for precipitation when the amount is less than 5%. In addition, the lower limit of the strain rate is determined to be $1\times10^{-2}$ $S^{-1}$, since when the strain is lower than this limit, plastic deformation is mainly applied to the gamma grain boundary to accelerate the precipitation of carbo-nitrides and sulfides along the gamma grain boundary. This precipitation is also accelerated by the application of heat treatment including cooling and self-heating. In order to introduce strains at high temperature it is necessary to cause the precipitates to grow before the introduced dislocations are recovered. For this purpose, a strain rate higher than $1\times10^{-2}$ $S^{-1}$is sufficient.

According to one preferred embodiment of this invention, the plastic deformation is applied at a temperature of 900°-500° C., and thereafter at least one time the slab is cooled to a temperature below the $Ar_3$ point. This is because the refinement of gamma grains by way of transformation is no longer necessary when the slab is heated at a temperature higher than 900° C. At high tempertures the precipitates grow coarse. On the other hand, a temperature lower than 500° C. is impractical.

Figure 9:
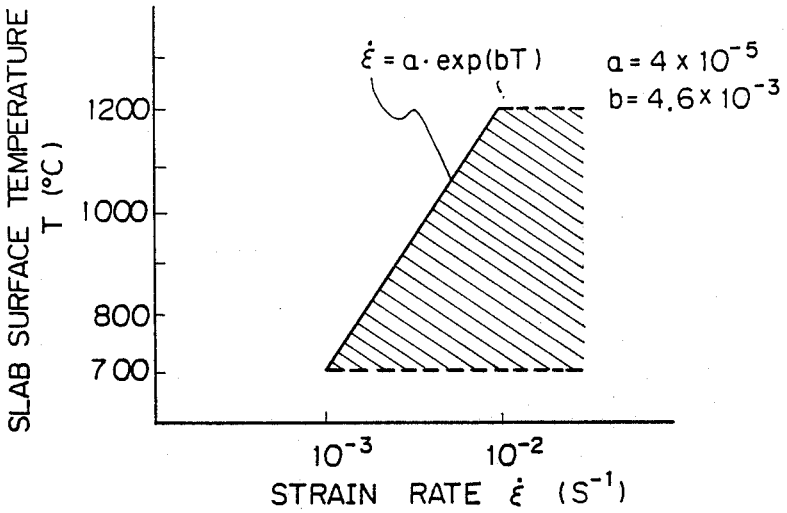
FIG. 9 is a graph showing strain rates employed in the present invention.

In another preferred embodiment of this invention, the strain rate is restricted to: $\dot{\epsilon}\geqq a\times\exp(bT)$ because it is necessary to produce the growth of the precipitates before the introduced dislocations recover. At a higher temperature a larger strain rate is required so as to build up strains. The temperature at which the plastic deformation takes place is limited to 700° C.-1200° C. The hatched area in FIG. 9 shows the range in which the preferred embodiments are carried out. An apparatus by which such deformation is performed on the cast slab according to this invention includes a roller having projections along its periphery, an air hammer, a specially arranged hydraulic oil press, and the like. So long as the intended plastic deformation and strain rate can be achieved, other methods or apparatuses may be used.

Figure 10:
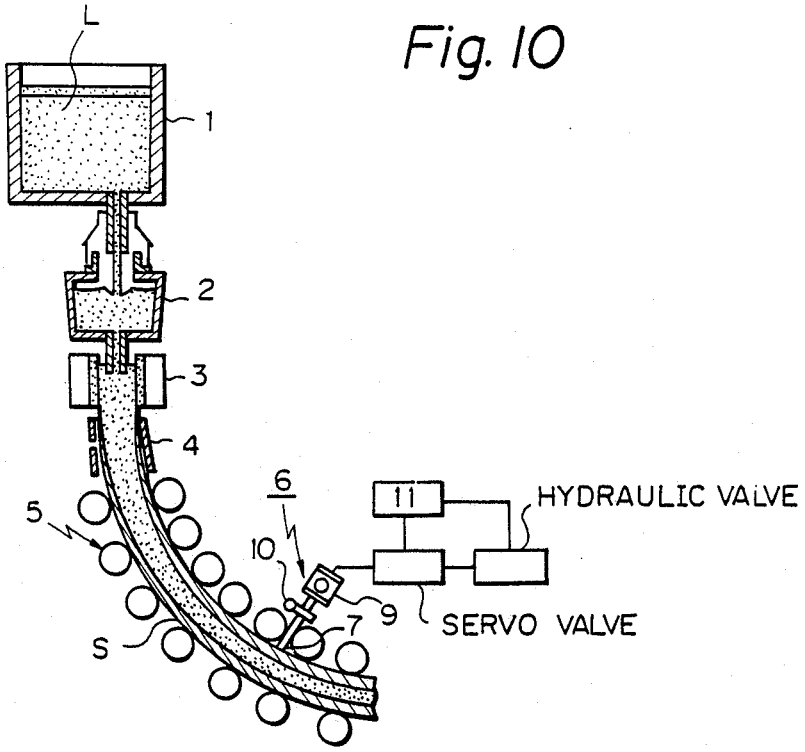
Figure 11:
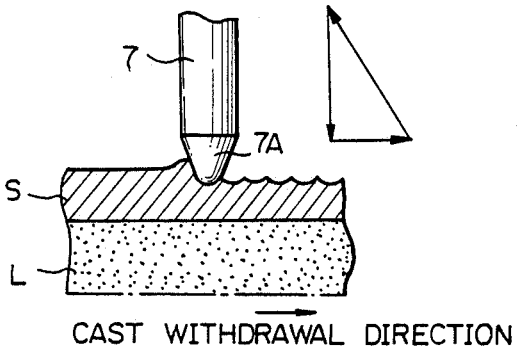

FIGS. 10 and 11 schematically illustrate one example of an apparatus for applying plastic deformation to a continuously cast slab.

Molten steel L is continuously cast through a ladle 1 and a tundish 2 into a mold 3. The cast slab is withdrawn through cooling grids 4 and a series of guide rollers 5 while forming a solidified shell S, then is straightened while moving horizontally through levelling rollers (not shown) and removed from the machine. Prior to being subjected to straightening, the cast slab is subjected to plastic deformation by means of a surface processing apparatus 6 comprising a working tool 7 with a projection 7A, which is forced against the solidified shell S on the slab surface to a depth of 1-5 mm at a frequency of at least 50 times per minute. Thus, strains of 5% or more are advantageously introduced at a rate of $1\times10^{-2}$ $S^{-1}$ or higher to promote coagulation of carbo-nitrides, resulting in coarse precipitates.

Figure 13:
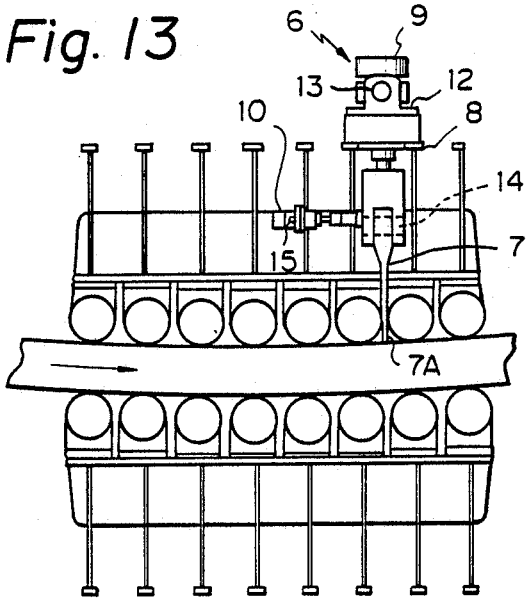
FIGS. 10–14 are views schematically illustrating a surface processing apparatus with which this invention process is carried out.
Figure 12:
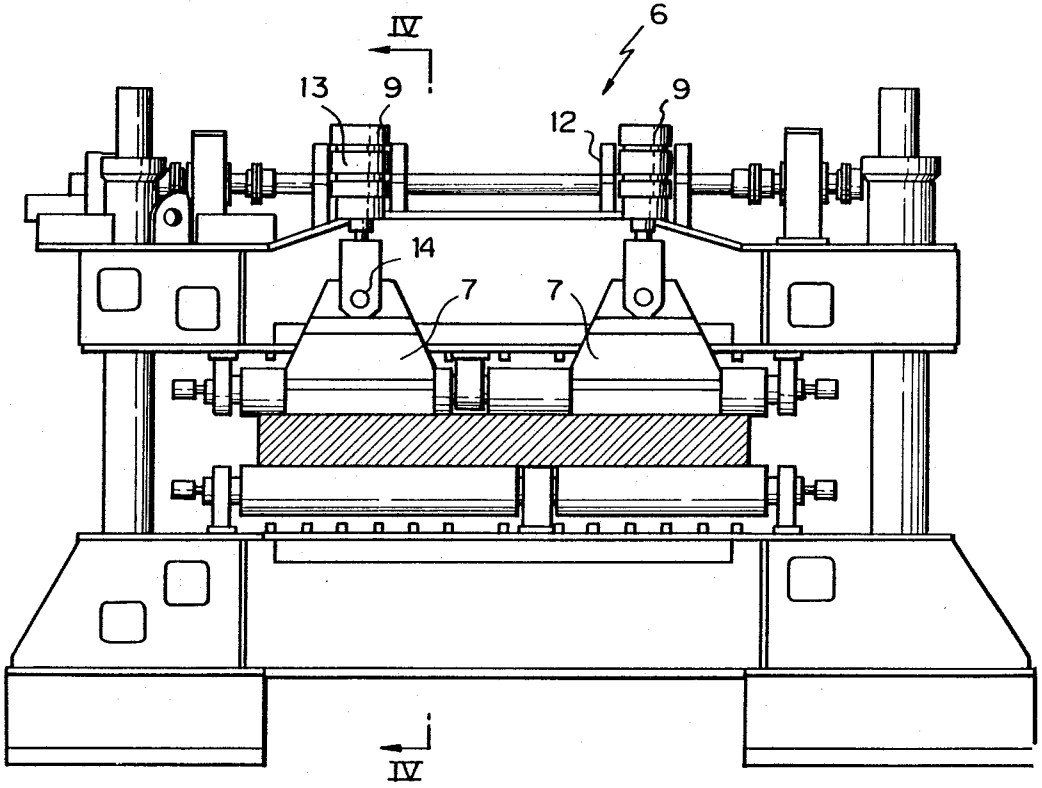
Figure 14:
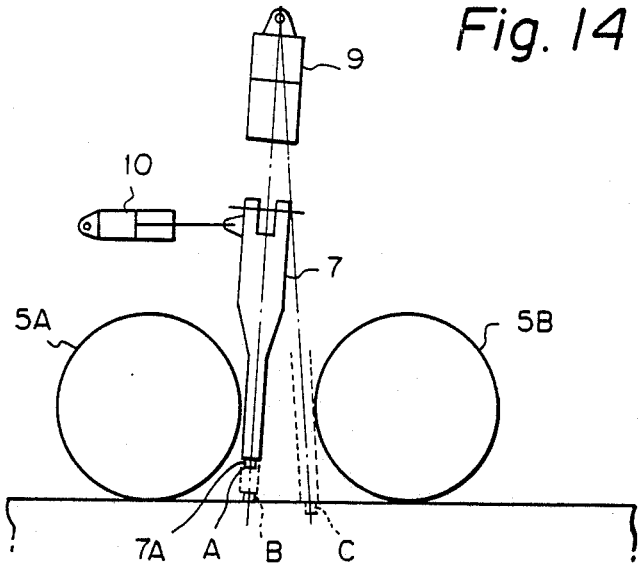

FIGS. 12, 13, and 14 illustrate in detail the surface processing apparatus 6. As shown in FIGS. 13 and 14, the apparatus 6 is usually installed on a roller apron frame 8 for guide rollers 5 provided along the radially inner surface during bending. The arrangement is designed such that strains are applied to the surface of the slab in the direction of the depth of the cast slab between the rollers. As shown in more detail in FIGS. 13 and 14, the apparatus comprises a working tool 7 having a projection 7A for forming a dent in the slab surface, a first hydraulic cylinder 9 which moves the working tool 7 back and forth towards and away from the slab surface, a second hydraulic cylinder 10 which moves the working tool 7 back and forth in the direction of withdrawal of the cast slab, a control unit 11 which is connected to the first and second drive means 9, 10 and which controls the movement of the working tool 7 in the two directions.

The first hydraulic cylinder 9 is pivotally mounted on the roller apron frame 8 through a seat 12 and a pin 13 so as to be able to pivot in the direction of slab withdrawal, and the piston rod of the cylinder 9 is connected to the top end of the working tool 7 by a pin 14 and is movable in the direction of the thickness of the slab.

The projection 7A may be attached to the working tool 7 in such a manner that the projection 7A can be replaced by a different one or a new one when necessary.

The second hydraulic cylinder 10 is pivotally attached to the roller apron frame 8 by a pin 15 and the working tool 7 is movable in the direction of the thickness of the slab, too.

The hydraulic cylinders 9, 10 are actuated by a servo valve which is in turn controlled by a control unit 11 on the basis of input signals corresponding to the pouring rate, indentation depth, processing conditions, and the like so that the working tool 7 will follow the path shown by the arrows in FIG. 11.

During the movement of the working tool 7 and projection 7A, as shown in FIG. 14, the tip of the working tool 7 is first positioned at a point A a few millimeters away from the cast slab surface, where it is adjacent to a guide roller 5A on the upstream side of the slab. When the processing commences, the working tool 7 is actuated by the first hydraulic cylinder 9 and the tip goes down to a point B on the slab surface. Upon contact with the surface, the working tool 7 is actuated by the second hydraulic cylinder 10 and the projection 7A is moved downstream in the slab withdrawal direction while being forced against the slab surface.

The indentation of the slab surface by the projection 7A ends at a point C near the downstream guide roller 5B. The working tool 7 is then removed from the surface by the actuation of the first hydraulic cylinder 9 and is returned to its starting point A by means of the second hydraulic cylinder 10.

The above cycle is repeated continuously to impart a given amount of strain to the slab surface.

Instead of the hydraulic cylinders mentioned above, an eccentric member may be employed to actuate the working tool.

EXAMPLE 1

In this example, the influence of indentation depth and the frequency of indentation on the formation of cracks was determined using a processing apparatus like the one shown in FIG. 10 through FIG. 14. A melt of low alloy steel was poured into a continous casting mold at a pouring rate of 0.9 m/min.

The test results are shown in Table 3 below.

TABLE 3

| Depth of Indentation (mm) | Indentation Frequency (Indentations/Min) 30 | 50 | 100 | 200 |
|---|---|---|---|---|
| 1 | Δ | Δ | O | O |
| 2 | Δ | Δ | O | O |
| 3 | Δ | O | O | O |
| 4 | Δ | O | O | O |
| 5 | Δ | O | O | O |
| 6 | X | X | X | X |

Note:
O: No Surface Cracks
Δ: Some Cracks
X: Many Cracks

EXAMPLE 2

Cast slabs (250 mm×2100 mm) were continuously produced by a bending-type continuous casting machine (bending radius: 12.5 m) like that shown in FIG. 10 under various manufacturing conditions. The formation of surface cracks was visually examined after leveling. By means of the surface processing apparatus 6 shown in FIG. 10, strains were introduced into the slab which was only partially solidified.

In this example, the diameter of the round tip portion of the projection 7A was 5 mm, the depth of indentation was 3 mm, and the indentation frequency was 180 times per minute. The strain rate under these conditions was 0.3 $S^{-1}$ with the average amount of strains being 7% to a depth of 3 mm from the surface.

Table 4 shows the steel composition used in this example and Table 5 summarizes casting conditions and the results of visual examination of the formation of surface cracks.

As is apparent therefrom, according to the conventional process, there were numerous cracks. However, according to the process of this invention, there were no cracks in the slab surface.

TABLE 4

| C | Si | Mn | P | S | Nb | V | Al | N | $Ar_3$ Point |
|---|---|---|---|---|---|---|---|---|---|
| 0.10 | 0.30 | 1.65 | 0.015 | 0.004 | 0.035 | 0.07 | 0.035 | 0.0055 | 725° C. |

TABLE 5

| Casting Speed (m/min) | Slab Temperature at Processing Point (°C.) | Slab Surface Temperature at Leveling Point (°C.) | Amount of Cracks | Remarks |
|---|---|---|---|---|
| 0.9 | 680–700 | 800 | None | *1 |
| 0.9 | — | 820 | Numerous | *2 |

Note:
*1 This invention
*2 Conventional

Figure 15:
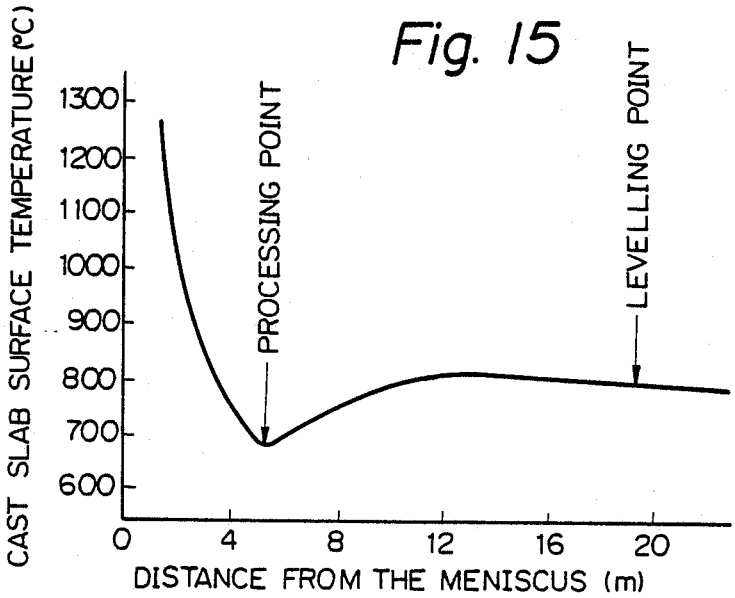
FIGS. 15–16 are graphs showing heat patterns each employed in a working example of this invention.

FIG. 15 is a cooling curve for this example illustrating the tempertaure of the slab as a function of distance from the meniscus, and also showin the points at which processing and leveling were performed (hereunder referred to as "heat pattern").

EXAMPLE 3

In this example, the same apparatus was used to produce cast slabs (250 mm×2100 mm) having the steel composition shown in Table 6. The formation of cracks after leveling was visually examined.

Figure 16:
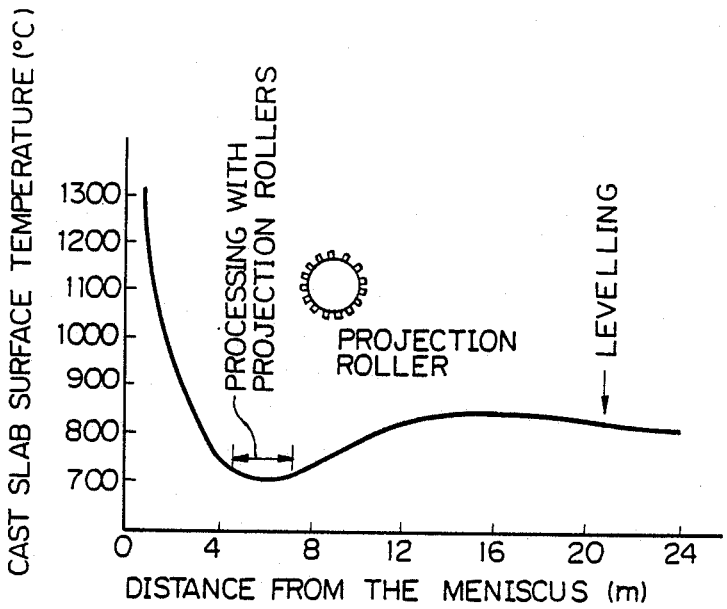
Figure 17:
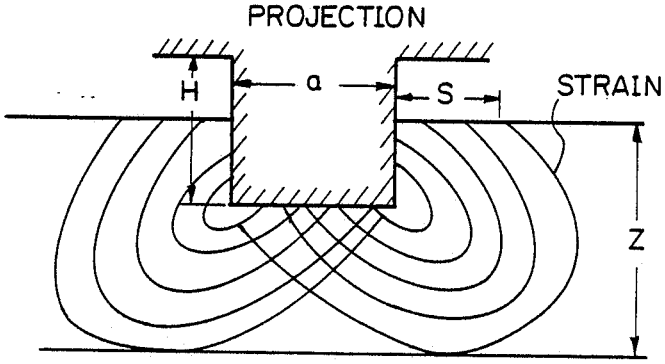
FIG. 17 is a schematic view of the propagation of strains when projection rollers were used.

The heat pattern for this example is shown in FIG. 16. The strains were introduced using a series of projection rollers in place of guide rollers arranged at a distance of 4–8 m from the melt surface within the mold, i.e., the meniscus. Each projection was forced against the shell S 46–65 mm thick while receiving a molten metal pressure at 28–52 kg/cm². As is schematically shown in FIG. 17, with a projection roller strains propagate from each of the projections. According to calculations using the following equations, at least a 7% strain was imparted to a depth of 5 mm from the surface. The strain rate was $2\times10^{-1}$ $S^{-1}$.

$$H=(Z+0.5)-1/\sqrt{2}\times a$$

$$S=(1.8-2.2)\times a$$

In order to impart at least a 5% strain, it is required that "a" be 7 mm and "H" be 3 mm.

The test results are summarized in Table 7. As shown in the Table, according to this invention, although dent marks remained in the slab surface, there were no cracks in the surface.

TABLE 6

| C | Si | Mn | P | S | Nb | Al | N | $Ar_3$ Point |
|---|---|---|---|---|---|---|---|---|
| 0.08 | 0.30 | 1.45 | 0.012 | 0.005 | 0.035 | 0.032 | 0.0043 | 750° C. |

TABLE 7

| Casting Speed (m/min) | Slab Temp. Upon Passing Projection Roller (°C.) | Slab Surface Temperature at Leveling Point (°C.) | Amount of Cracks | Remarks |
|---|---|---|---|---|
| 1.2 | 700–730 | 820 | None | *1 |
| 1.2 | — | 830 | Numerous | *2 |

Note:
*1 This invention
*2 Conventional

EXAMPLE 4

In this example, slabs processed in accordance with this invention were subjected to direct rolling after leveling and cutting.

Figure 18:
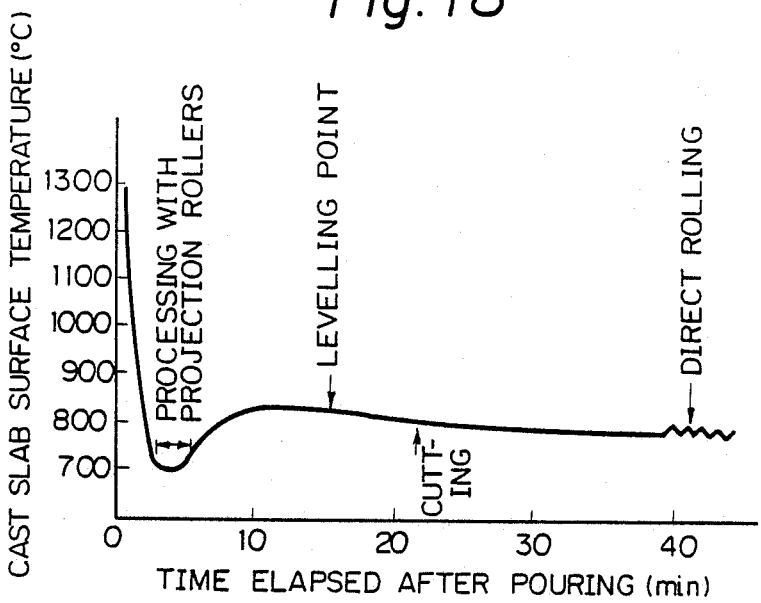
FIGS. 18–19 are graphs showing heat patterns each employed in a working example of this invention.

The steel compositions are shown in Table 8 and the heat pattern is shown in FIG. 18. Strains were introduced by means of four sets of projection rollers provided on both sides of the slab. Direct rolling was carried out using a roll 1,300 mm in diameter and the slab was rolled down to a thickness 150 mm in 5 passes.

The formation of surface cracks was visually examined and the results are summarized in Table 9.

As is apparent from Table 9, markedly improved results can be obtained in accordance with this invention.

TABLE 8

| Steel | C | Si | Mn | P | S | Nb | Al | N | $Ar_3$ Point |
|---|---|---|---|---|---|---|---|---|---|
| I | 0.05 | 0.03 | 0.2 | 0.015 | 0.010 | — | 0.040 | 0.0045 | 850° C. |
| II | 0.09 | 0.30 | 1.2 | 0.017 | 0.011 | 0.04 | 0.045 | 0.0050 | 760° C. |

TABLE 9

| Test Run | Steel | Casting Speed (m/min) | Slab Temp. Upon Passing Projection Roller (°C.) | Amount of Cracks | Remarks |
|---|---|---|---|---|---|
| 1 | I | 1.4 | — | Numerous | — *1 |
| 2 | II | " | — | Numerous | Rolling *1 Had to be Discontinued |
| 3 | I | " | 720–660 | None | — *2 |

TABLE 9-continued

| Test Run | Steel | Casting Speed (m/min) | Slab Temp. Upon Passing Projection Roller (°C.) | Amount of Cracks | Remarks |
|---|---|---|---|---|---|
| 4 | II | " | 720–660 | None | — *2 |

Note:
*1 Comparative
*2 This Invention

EXAMPLE 5

In this example, steel castings (40×220×660 mm) having the steel compositions given in Table 10 were prepared, and surface strains were introduced over half of the surface area of each casting using a small motor hammer under the conditions shown in Table 11. The average amount of strain was about 20% to a depth of 5 mm from the surface.

The thus obtained cast pieces were subjected to bending by means of hydraulic pressure. The surface was visually inspected for cracks. In the one half of the surface of each casting in which deformation by means of the motor hammer was not applied, there were deep crakcs 20–50 mm long for Steel II. However, in the other half of the surface, there were no surface cracks at all.

TABLE 10

| Steel | C | Si | Mn | P | S | Nb | Al | N | Remarks |
|---|---|---|---|---|---|---|---|---|---|
| I | 0.05 | 0.03 | 0.20 | 0.015 | 0.015 | — | 0.040 | — | Low-C Al-killed Steel |
| II | 0.16 | 0.35 | 1.45 | 0.015 | 0.010 | 0.05 | 0.050 | — | Nb-Steel |

TABLE 11

| Test No. | Steel Type | Temperature During Surface Straining (°C.) | Piston Speed (mm/S) | Bending Strain Rate ($S^{-1}$) |
|---|---|---|---|---|
| 1 | I | 1170–1060 | 40 | 0.36 |
| 2 | II | 1140–1060 | 0.07 | $6 \times 10^{-4}$ |
| 3 | II | 1190–1120 | 0.35 | $3 \times 10^{-3}$ |
| 4 | II | 1100–1050 | 0.12<br>0.35 | $1 \times 10^{-3}$<br>$3 \times 10^{-3}$ |

EXAMPLE 6

This example was the same as Example 2 except that the temperature at which strains were introduced was rather high. Process conditions and test results are summarized in Table 12.

TABLE 12

| Casting Speed (m/min) | Slab Temperature at Processing Point (°C.) | Slab Surface Temperature at Leveling Point (°C.) | Amount of Cracks | Remarks |
|---|---|---|---|---|
| 0.9 | 1100–1120 | 900–950 | None | *1 |
| 0.9 | — | 900–950 | Numerous | *2 |

Note:
*1 This invention
*2 Conventional

EXAMPLE 7

This example was identical to Example 6 except that before effecting deformation, the cast pieces were cooled rapidly from 1350° C. to 800° C., where the deformation was carried out. After deformation, the surface temperature recovered to 1000° C. by self-heating. The levelling was applied at 900° C.

The steel composition employed in this example is shown in Table 13 and the test results are summarized in Table 14.

According to a conventional method in which no deformation was applied before leveling, there were many cracks in the surface. However, cast slabs processed in accordance with this invention had no cracks in the surface at all.

TABLE 13

| C | Si | Mn | P | S | Nb | V | Al | N |
|---|---|---|---|---|---|---|---|---|
| 0.10 | 0.27 | 1.58 | 0.013 | 0.005 | 0.033 | 0.06 | 0.041 | 0.0063 |

TABLE 14

| Casting Speed (m/min) | Slab Temperature at Processing Point (°C.) | Slab Surface Temperature at Leveling Point (°C.) | Amount of Cracks | Remarks |
|---|---|---|---|---|
| 0.7 | 780–850 | 850–920 | None | *1 |
| 0.7 | — | 850–920 | Numerous | *2 |

Note:
*1 This invention
*2 Conventional

EXAMPLE 8

Figure 19:
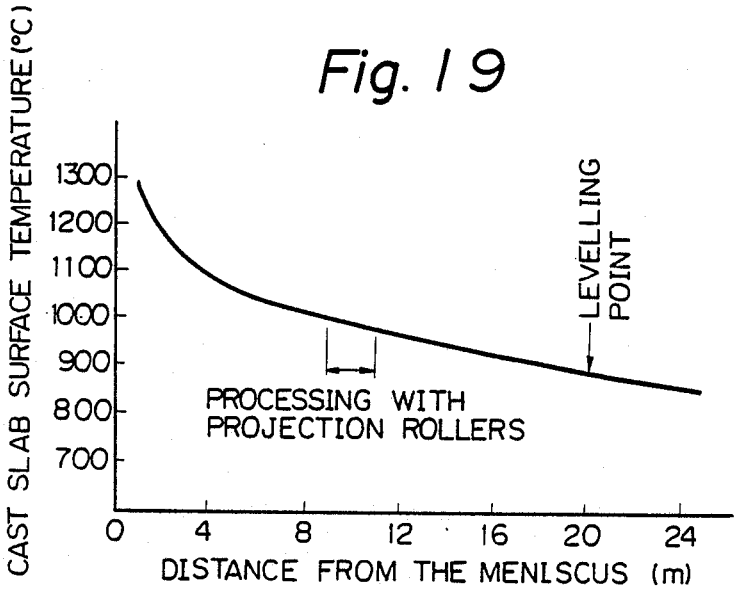

This example was the same as Example 3 except that the processing point and the heat pattern were shown in FIG. 19.

The test results are summarized in Table 15.

TABLE 15

| Casting Speed (m/min) | Slab Temp. Upon Passing Projection Roller (°C.) | Slab Surface Temperature at Leveling Point (°C.) | Amount of Cracks | Remarks |
|---|---|---|---|---|
| 1.1 | 1000–970 | 890 | None | *1 |
| 1.1 | — | 880 | Numerous | *2 |

Note:
*1 This invention
*2 Conventional

EXAMPLE 9

In this example, Example 4 was repeated.

The test results are summarized in Table 16.

TABLE 16

| Test Run | Steel | Casting Speed (m/min) | Slab Temp. Upon Passing Projection Roller (°C.) | Amount of Cracks | Remarks |
|---|---|---|---|---|---|
| 1 | I | 1.4 | — | Numerous | — *1 |
| 2 | II | " | — | Numerous | Rolling *1 Had to be Discontinued |
| 3 | I | " | 1100–1080 | None | — *2 |
| 4 | II | " | 1100–1085 | None | — *2 |

Note:
*1 Comparative
*2 This Invention

Although the present invention has been described with preferred embodiments it is to be understood that variations and modifications may be employed without departing from the concept of the present invention as defined in the following claims.

What is claimed is:

1. An apparatus for treating continuously cast slab having a surface, said slab being provided between guide rollers of a continuous casting machine, the surface of the slab passing through said guide rollers at a point after being continuously cast, comprising a working tool to form a dent in the slab surface, a first drive means to move said working tool towards and away from the slab surface, a second drive means to move said working tool alternately between a first position and a second position spaced from the first position in the direction of the passage of the slab, and a control unit connected to said first and second drive means for adjusting the movement of said working tool towards and away from the slab surface and alternately between the first and second positions.

2. The apparatus defined in claim 1, wherein said point is immediately prior to means for straightening the slab.

3. The apparatus defined in claim 1, wherein the working tool comprises a projection which is forced against the slab surface to a depth of 1–5 mm at a frequency of at least 50 times per minute.

4. An apparatus for treating continuously cast slab having a surface, said slab being provided between guide rollers of a continuous casting machine, the surface of the slab passing through said guide rollers after being continuously cast, comprising a working tool having a projection for forming a dent in the slab surface, a first hydraulic cylinder which moves the working tool towards and away from the slab surface, a second hydraulic cylinder which moves the working tool alternately between a first position and a second position spaced from the first position in the direction of the passage of the slab, a control unit which is connected to the first and second drive means and which controls the movement of the working tool towards and away from the slab surface and alternately between the first and second positions.

5. The apparatus defined in claim 4, wherein the first hydraulic cylinder is pivotally mounted on a roller apron frame so as to be able to pivot between the first and second positions, and a piston rod of the first hydraulic cylinder is connected to the top end of the working tool and is movable in a direction of the thickness of the slab.

6. The apparatus defined in claim 4 wherein the second hydraulic cylinder is pivotally attached to a roller apron frame and the working tool is movable in a direction of the thickness of the slab.

7. The apparatus defined in claim 4 wherein the first and second hydraulic cylinders are connected to and actuated by a servo valve which is in turn controlled by a control unit having means for receiving input signals corresponding to the pouring rate, indentation depth, and processing conditions.

* * * * *